US006290188B1

(12) United States Patent
Bassett

(10) Patent No.: US 6,290,188 B1
(45) Date of Patent: Sep. 18, 2001

(54) COLLISION AVOIDANCE SYSTEM FOR TRACK-GUIDED VEHICLES

(75) Inventor: Michael R. Bassett, Westwood, MA (US)

(73) Assignee: PRI Automation, Inc., Billerica, MA (US)

( * ) Notice: Subject to any disclaimer, the term of this patent is extended or adjusted under 35 U.S.C. 154(b) by 0 days.

(21) Appl. No.: 09/506,705

(22) Filed: Feb. 18, 2000

Related U.S. Application Data

(60) Provisional application No. 60/120,509, filed on Feb. 18, 1999.

(51) Int. Cl.[7] ..... B61L 23/00

(52) U.S. Cl. ..... 246/182 R; 246/1 C; 246/201; 246/474

(58) Field of Search ..... 246/182 B, 167 R, 246/182 R, 473 R, 474, 166, 1 C; 340/901, 902, 903; 356/4.01

(56) References Cited

U.S. PATENT DOCUMENTS

| | | | |
|---|---|---|---|
| 3,365,572 | 1/1968 | Strauss | 246/167 |
| 3,952,301 | 4/1976 | Sorkin | 343/7 VM |
| 4,309,758 | 1/1982 | Halsall et al. | 364/424 |
| 4,530,056 | 7/1985 | MacKinnon et al. | 364/424 |
| 4,623,966 | 11/1986 | O'Sullivan | 364/461 |
| 4,653,002 | 3/1987 | Barry | 364/424 |
| 4,802,096 | 1/1989 | Hainsworth et al. | 364/461 |
| 4,902,948 | 2/1990 | Sherman et al. | 318/580 |
| 4,987,540 | 1/1991 | Luke, Jr. | 364/424.02 |
| 5,023,790 | 6/1991 | Luke, Jr. | 364/424.02 |
| 5,075,853 | 12/1991 | Luke, Jr. | 364/424.02 |
| 5,111,401 | 5/1992 | Everett, Jr. et al. | 364/424.02 |
| 5,166,681 | 11/1992 | Bottesch et al. | 340/933 |
| 5,216,605 | 6/1993 | Yardley et al. | 364/424.02 |
| 5,249,157 | 9/1993 | Taylor | 340/903 |
| 5,283,739 | 2/1994 | Summerville et al. | 364/424.02 |
| 5,305,693 | 4/1994 | Johnson et al. | 104/299 |
| 5,329,449 | 7/1994 | Tanizawa et al. | 364/424.02 |
| 5,386,364 | 1/1995 | Tyler | 364/424.02 |
| 5,471,214 | 11/1995 | Faibish et al. | 342/70 |
| 5,493,642 | 2/1996 | Dunsmuir et al. | 395/161 |
| 5,594,414 | 1/1997 | Namngani | 340/436 |
| 5,642,869 | 7/1997 | Miller | 246/182 B |
| 5,739,660 | 4/1998 | Gnann | 318/626 |
| 5,845,725 | 12/1998 | Kawada | 180/167 |

*Primary Examiner*—Mark T. Le
(74) *Attorney, Agent, or Firm*—Weingarten, Schurgin, Gagnebin & Hayes LLP

(57) ABSTRACT

A system to allow track-guided vehicles to avoid collisions with one another in straight track and curved track situations utilizing vehicle mounted devices and without the need for additional active traffic control devices. The system includes track-guided vehicles equipped with a plurality of selective sensors on the front and identifying reflective elements on the rear. Reflective strips mounted on the inner face of curved track allow the selective sensors to detect targets around curves. Retroreflective sensors coupled with corner cube reflective material are a preferred set of sensor and target implementations. The placement of the sensors and reflective elements is specified such that a calibrated system limits the range of the system and is easily maintained.

30 Claims, 5 Drawing Sheets

COLLISION AVOIDANCE SYSTEM FOR TRACK-GUIDED VEHICLES

CROSS REFERENCE TO RELATED APPLICATIONS

Applicant claims priority under 35 U.S.C. §119(e) to U.S. provisional application Ser. No. 60/120,509 filed Feb. 18, 1999.

STATEMENT REGARDING FEDERALLY SPONSORED RESEARCH OR DEVELOPMENT

N/A

BACKGROUND OF THE INVENTION

Electrically powered vehicles are often used in manufacturing and warehouse environments for transporting and manipulating articles of manufacture. Such vehicles are desirable in such environments due to their clean operation and low noise. Often such vehicles are propelled along a fixed rail or track, allowing precise control of movement along a predetermined path.

In particular, computer controlled materials transport systems are known for moving materials among various work stations of a facility. Such systems are employed, as an example, in semiconductor fabrication facilities for moving semiconductor wafers to successive work stations. In such a wafer transport system, a monorail track is routed past the work stations and a plurality of electric vehicles are mounted on the track and moveable there-along for delivering wafers to successive work stations and for removing wafers therefrom after requisite processing operations have been accomplished. The track is composed of interconnected track sections that usually include one or more routing sections or modules that are operative to provide plural paths along the track.

The vehicles on the track can operate in two modes—connected or semi-independent. In connected operation, a central controller, usually a computer, assigns destinations to vehicles and monitors operation of the whole system even when the vehicles are not at a station. The central controller monitors for collisions, obstacles and other extraordinary conditions, issuing commands to the vehicles to avoid undesired actions. While this mode allows more complex responses to conditions, it requires constant communication with the vehicles, a more powerful central controller and may have less flexible response to changing conditions.

In semi-independent mode, a central controller dispatches the vehicles and controls them when they are at a station but does not monitor the real-time operation of the system. The vehicles and/or track have facilities built in to allow the vehicles to sense their condition and respond it. This system requires some intelligence in the vehicles and may require expensive sensors to detect operational and extraordinary conditions.

Even when tracks are mounted overhead, obstacles such as hanger poles, manufacturing equipment, tools, walls and maintenance personnel can be present. The semi-independent vehicles need to sense and protect the payload from collisions with such obstacles. The avoidance of these obstacles is well known in the art.

The avoidance of other vehicles on the track has been accomplished in a number of ways; the track has been regarded as a number of zones and only one semi-independent vehicle may occupy a zone at one time, semi-automatic vehicles have been fitted with radar like capabilities and the intelligence to compute when collisions are likely, and semi-independent vehicles have treated obstacle vehicles like any other obstacle and stopped themselves. These alternatives have increased the installation cost of the system and may not allow a tailored response to other vehicles.

Curves in the track pose particularly difficult problems for semi-independent operating vehicles. Active traffic control devices have been needed at corners to assure that collisions are avoided near these features.

SUMMARY OF THE INVENTION

The invention allows track-guided vehicles to avoid collisions with one another in straight track and curved track situations utilizing vehicle mounted devices and without the need for additional active traffic control devices. The system is based on two complementary sensor systems, one to detect all obstacles and act to avoid track obstructions and the other, based on a sensor/target configuration, to detect other vehicles and prevent collisions between vehicles while protecting the payload. The system uses four special polarized retroreflective sensors and tuned targets to detect vehicles.

DESCRIPTION OF THE DRAWINGS

The invention will be more fully understood from the following detailed description taken in conjunction with the accompanying drawings in which.

DETAILED DESCRIPTION OF THE INVENTION

Figure 1:
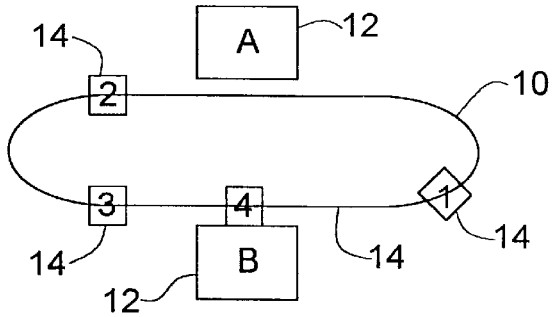
FIG. 1 (PRIOR ART)
FIG. 1 is a plan view of a track-based transport system.

FIG. 1 illustrates a simplified version of a track-based transport system as used in a manufacturing environment. The track 10 runs past processing stations 12. Vehicles 14 deliver material to be processed and retrieve the finished article to deliver to the next station. The vehicles must not collide with each other. If vehicle 4 is delivering material to processing station 12B, vehicle 4 is stopped, thereby blocking the track. Vehicle 3, following vehicle 4, must stop before colliding with vehicle 4. Vehicle 2, around the curve from vehicle 3, must detect that vehicle 3 has stopped in sufficient time to prevent colliding with vehicle 3. Vehicle 1 can travel until in the vicinity of station 12A before it too will need to stop to avoid a collision with vehicle 2.

Once vehicle 4 has moved out of collision range, vehicle 3 can restart. Similarly vehicles 2 and 1 can restart when their respective obstacle vehicle is out of range. Knowing that possible obstacle vehicles will be on the same track as a following vehicle allows efficient utilization of sensors when the objective is limited to identifying obstacle vehicles rather than all obstacles.

The invention uses selective sensors, which respond only to reflections from specific targets to customize the response to obstacle vehicles. All vehicles are marked with the specific reflective material at locations on the vehicle that would be presented to a following vehicle as a collision is imminent.

Figure 2:
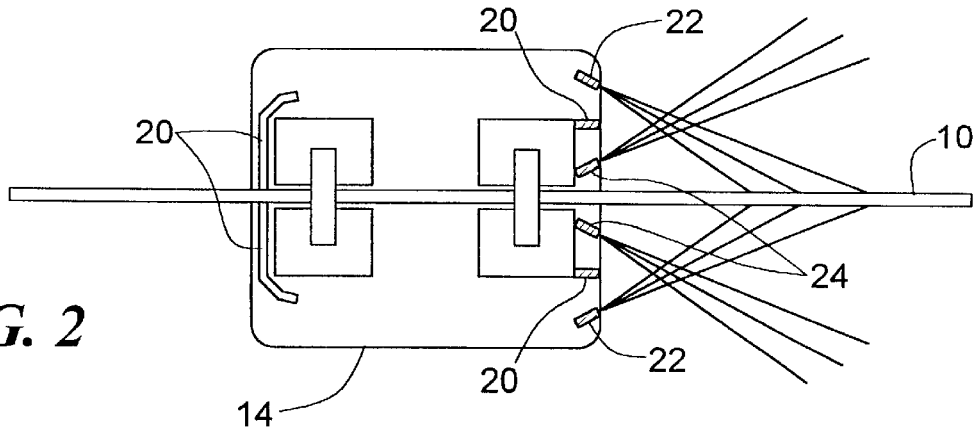
FIG. 2 is a top view of a vehicle showing the location of selective sensors, wideband sensors, and target tape.

FIG. 2 illustrates a vehicle 14 used in the disclosed system. Vehicle 14 travels along track 10. Primary selective sensors 22, placed on the outer third of the front of the vehicle, search for obstacle vehicles. Secondary selective sensors 24, placed on the inner third of the front of the vehicle, are utilized to further detect obstacle vehicles as will be described further on. General obstacle sensors 20, placed approximately in the middle of the front of the vehicle, as are known in the industry, are also used to detect all obstructions within a target acquisition area and stop the vehicle 14 if needed. Typically, the general obstacle sensors have a shorter range than the selective sensors and will decelerate the vehicle more quickly than the selective sensors. Therefore the general obstacle sensor can act as a back-up to the selective sensors. All sensors are mounted so they can be angled and tilted as needed for best operation.

Identifying reflective tape 26, which is disposed to work in conjunction with the selective sensors, is affixed to the rear of each vehicle. The tape is affixed to the vehicle rather than the payload carrier to allow a singe calibration even if the payload carrier is changed. The identifying reflective tape extends substantially across the entire width of the vehicle and curves slightly around the vehicle to improve operation. As vehicle 14 travels along the track 10, its selective sensors 22 will only detect reflections from identifying reflective tape 26. Therefore, the selective sensors respond only to other vehicles that are within the range of the selective sensors and do not perceive other obstacles.

Figure 3:
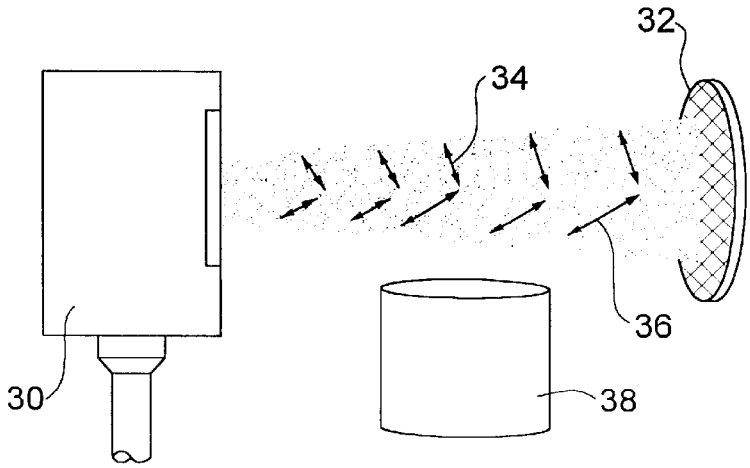
FIG. 3 is a diagram of the operation of a selective sensor.

FIG. 3 illustrates the operation of a preferred embodiment of the system in which the selective sensor 22 is a retroreflective sensor and the identifying tape 26 is corner cube reflective tape. The retroreflective sensor 30 transmits polarized light 34. When the polarized light 34 reflects from the corner cube reflector 32 it is depolarized so that some of the reflected light 36 will be oriented at 90° to the incident light. A normal object 38 will not depolarize the light, so any light reflecting from it will retain its polarization. A detector that is activated only by light polarized at 90° relative to the transmitted light will only "hit" when a corner cube reflector has been the target.

Figure 4:
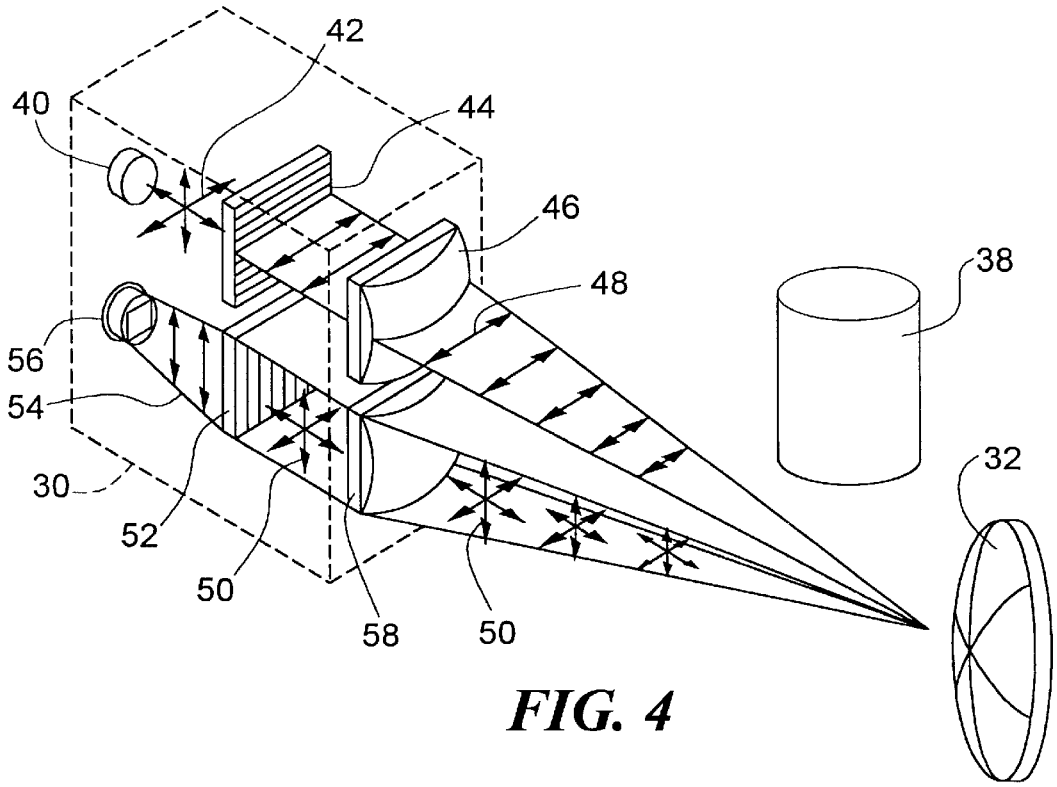
FIG. 4 is detail of the operation of a retroreflective sensor/target combination of the invention.

The retroreflective sensor used for the invention is configured as shown in FIG. 4. The sensor 30 contains a light source 40 putting out unpolarized light. A polarizing filter 44 polarizes the light in a single plane. A lens 46 focuses the polarized light. Corner cube reflector 32 depolarizes the polarized light 48 incident on it and reflects the depolarized light 50 back toward the sensor. The depolarized light 50 passes through the lens 58 and only that portion of the light 54 that is parallel to a second polarizing filter 52 (oriented at 90° to the first filter 44) passes through to be received by the photodetector.

Figure 5:
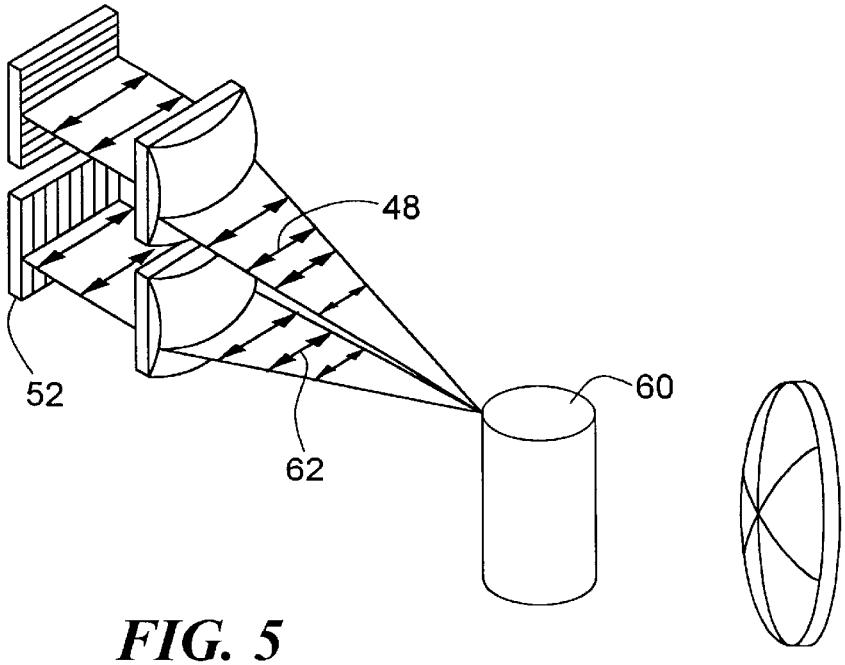
FIG. 5 is a diagram of the retroreflective sensor not detecting an ordinary obstacle.

FIG. 5 illustrates why this system doesn't see objects with ordinary reflective material rather than corner cube reflective material. The polarized light 48 emitted from the sensor strikes an obstacle 60 and is reflected back, still polarized. When this polarized light meets the rotated polarizing filter 52, no light passes through to be detected by the photodetector. Because the sensor system does not detect other objects which the sensor beams may cross, the sensing distance for these sensors may be relatively large without getting false hits.

The operation of the system can be calibrated with knowledge of the application to which it will be applied. If the maximum velocity, $v_m$, of the vehicles is known and the deceleration, $a_d$, that is to be used for obstacle vehicle stops, the time to stop the vehicle, t, and the stopping distance, d, can be calculated.

$$t=v_m/a_d$$

$$d=v^2/(2a_d)$$

If a longer stopping distance can be allowed, a gentler deceleration can be used. The gentler deceleration may allow bulkier cargoes to be carried by the vehicles. The range of the sensor must be greater than the stopping distance but should not be so great than targets beyond the desired range cause false hits. One way to limit the range of the sensors is to adjust the gain of the sensors. This method could require maintenance as the components age. In a preferred embodiment, the sensors and the identifying tape are disposed at approximately the same height on the vehicles, but the sensors are aimed at an upward angle to limit the distance at which the emitted light can impact the identifying tape. Further, the sensors are angled inward to assure that the light doesn't disperse beyond the desired region. This method reduces the amount of maintenance versus a gain adjustment and allows factory setting of the distance. In a preferred embodiment, a 30 inch (76 cm) range was reduced to a 20 inch (51 cm) range using this method.

When an obstacle vehicle is stopped ahead on a straight track, the primary sensors on both sides of the vehicle will register a hit. However, if one of the vehicles is on a curve, only one primary sensor may register a hit, or neither primary sensor may register a hit.

Figure 6:
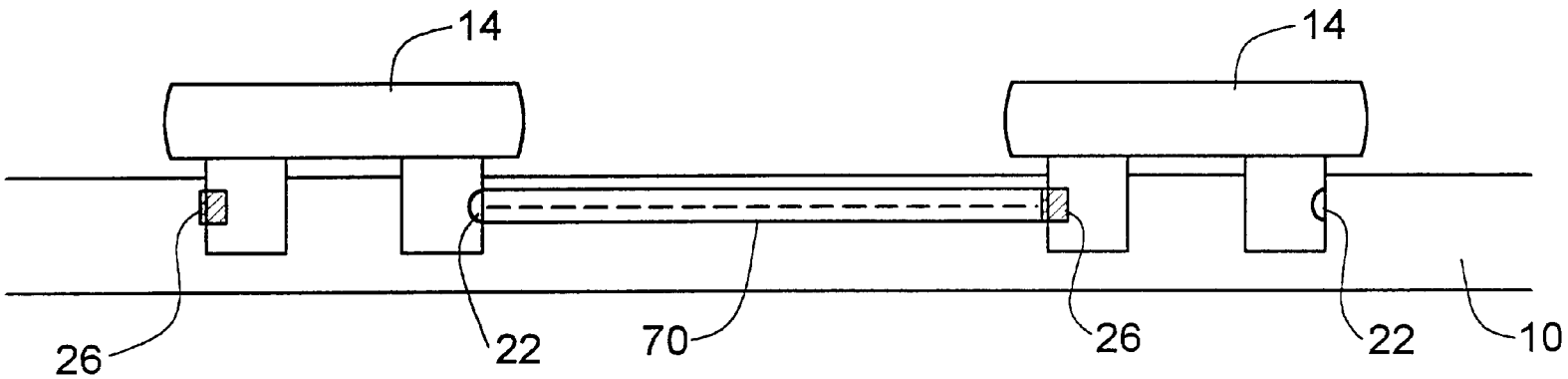
FIG. 6 is a side view of a preferred embodiment of placement of sensors and highly reflective tape.
Figure 7:
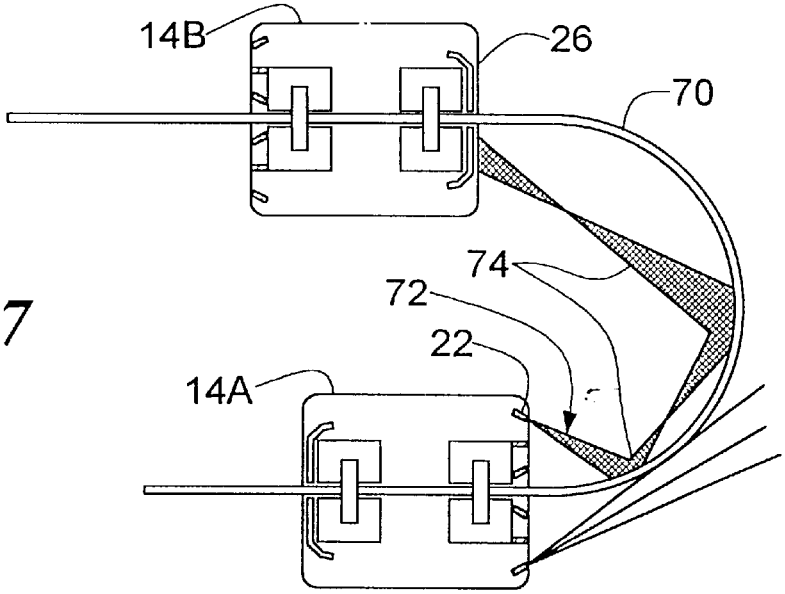
FIG. 7 is a top view of the operation of the system on a curved track.

In order to use the system on curved section of track, a highly reflective non-diffusing surface 70 is attached to the inner face of the curved track. FIG. 6 Illustrates that the centerline of the mounting of the sensors 22, identifying reflectors 26, and highly reflective non-diffusing surface 70 are approximately aligned. The reflective surface is used whenever the track is non-linear and extends for the entire length of each curve. This surface redirects the light 72 around the curve 74 as illustrated in FIG. 7. Because the sensing distance for the sensor is relatively large, the arc length distance of the curve can be accommodated. When a second vehicle 14B is stopped or too close around the bend of the curve, the incident polarized light will reflect off the corner cube reflector 26 on the back of the vehicle and be redirected back to the sensor 22 by the highly reflective non-diffusing surface on the track as unpolarized light. When the sensor 22 detects obstacle vehicle 14B, the logic associated with the vehicle 14A decelerates its vehicle to a stop. In a preferred embodiment, the deceleration is at a constant rate. This allows vehicles with a relatively large footprint relative to the radius of the curve and vehicles with a relatively large stopping distance relative to the arc length of the curve to detect an obstacle vehicle which is stopped in or just beyond the curve before the following vehicle enters the curve.

Figure 8:
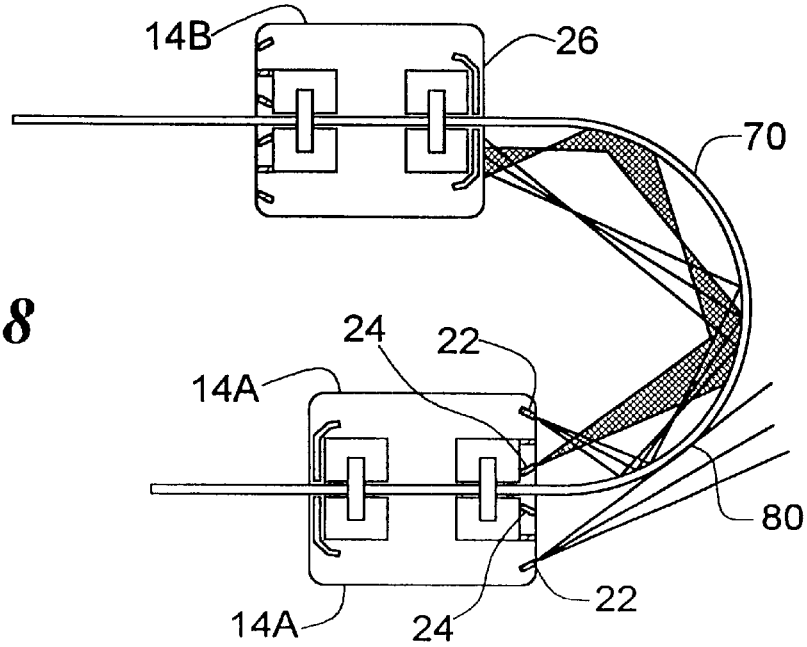
FIG. 8 is a top view illustrating the more complete coverage provided by adding a secondary sensor.

During the deceleration, the vehicle 14A may travel part way through the curve. The vehicle may pass through a "blind spot" where the reflected light from the obstacle vehicle 14B would not impinge on the sensor 22. FIG. 8 illustrates the use of a secondary sensor 24 in this situation.

When the primary sensor 22 senses an obstacle in its path, it starts the deceleration process and activates the secondary sensor 24. Both of these sensors send out a beam of polarized light that is redirected around the curve by the reflective surface 70 on the track. The beams are depolarized and reflected by the corner cube reflector 26 and redirected around the curve as they return to the vehicle 14A. If either the primary sensor 22 or the secondary sensor 24 detects obstacle vehicle 14B, the deceleration process continues, or if vehicle 14A has stopped, the vehicle remains stopped. The secondary sensor increases the amount of light in the transmission path and effectively provides a broader target for receipt of reflected light, thereby reducing the effect of "blind spots" on the operation of the collision avoidance system.

Figure 9:
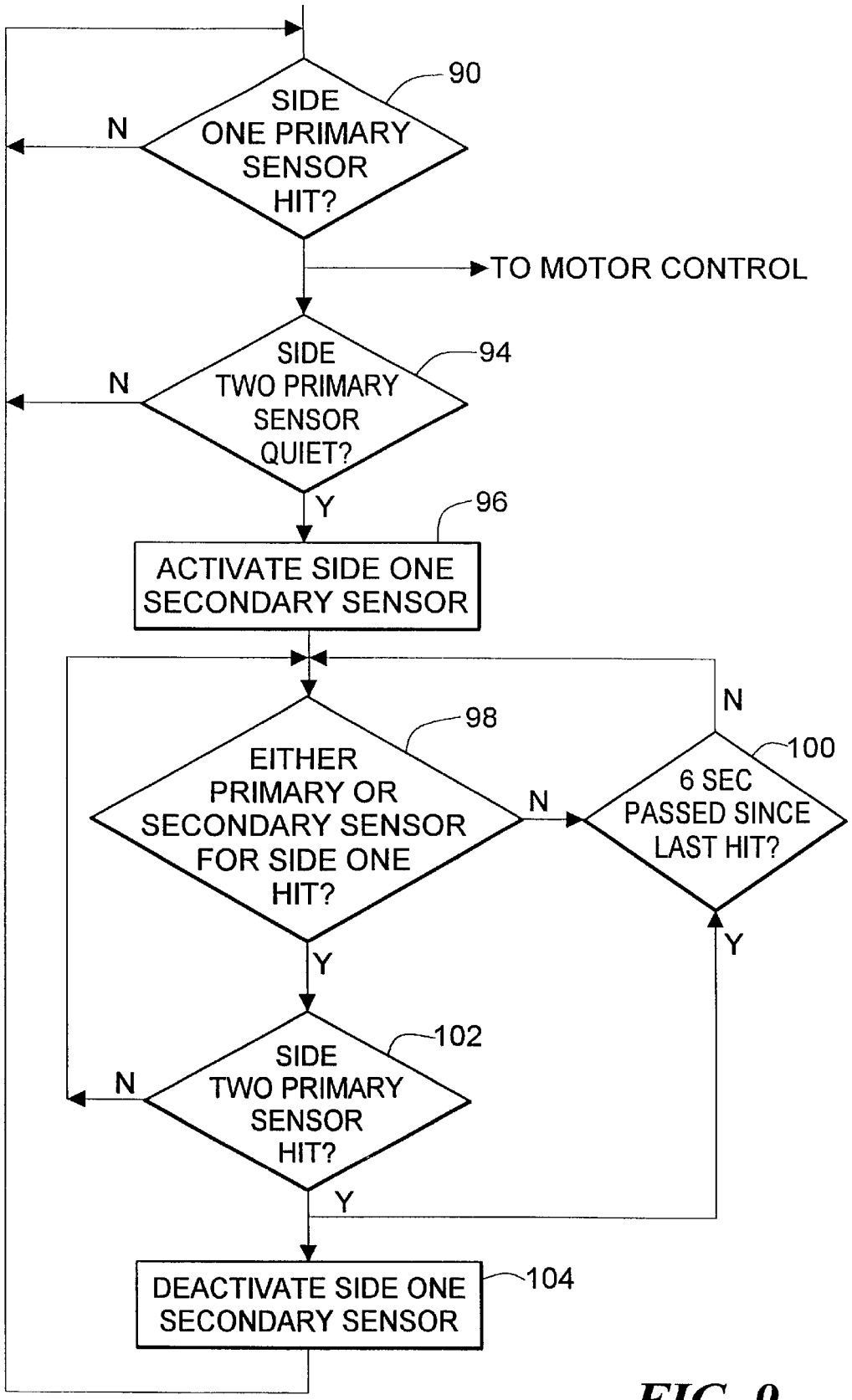
FIG. 9 is a flow chart of the logic utilized in activating and deactivating each secondary sensor.

Because the secondary sensors require excess power, they are operated only when needed and shut off as soon as possible. In a preferred embodiment, the logic of FIG. 9 is used to control the power to the secondary sensor for a single side of the vehicle. If the primary sensor for side one registers a hit 90, information is sent to the motor control to prevent the collision (where side one could be either the left or the right, with side two being the other side). If the sensor on the other side has not registered a hit 94, then the reflector returning the light is not straight ahead and the secondary sensor is needed. The secondary sensor on side one is activated 96 in this case. The logic then shifts into a mode of looking to turn off the secondary sensor. As long as either the primary or secondary sensor for side one is registering a hit 98, while the side two primary sensor is not registering a hit 102, the side one secondary sensor is maintained on. If both side one sensors are not registering a hit 98 and a suitable delay such as six seconds have passed since the last hit 100, then the side one secondary sensor is deactivated 104. Alternately, if a side one sensor and the primary side two sensor register hits 102, the side one secondary is deactivated because the obstacle has moved to directly in front of the vehicle.

In a preferred embodiment, a target velocity, $v_m$, of 100 ft/min and a deceleration, $a_d$, of 0.1 g were accommodated. These factors dictate a 6 inch (15 cm) stopping distance. A sensor range of 20 inches (51 cm) was found sufficient to provide sufficient warning to prevent collisions. In a typical corner for this configuration, the stopping distance equated to a 30° displacement into a curve. When payloads have large diameters, the system needs to be set up to detect the presence of the stopped vehicle before the payloads collide.

Having described preferred embodiments of the invention it will now become apparent to those of ordinary skill in the art that other embodiments incorporating these concepts may be used. Accordingly, it is submitted that the invention should not be limited by the described embodiments but rather should only be limited by the spirit and scope of the appended claims.

What is claimed is:

1. A system for avoiding collisions of track-guided vehicles on a track, the system comprising:

a plurality of track-guided vehicles having a front and a back;

a plurality of sensors, affixed to the front of each of said plurality of track-guided vehicles, said plurality of sensors being placed and focused to illuminate a predetermined area in front of said track-guided vehicle;

a strip of identifying reflective element disposed on the back of each of said plurality of track-guided vehicles; said strip being disposed at a predetermined height;

a plurality of highly reflective non-diffusing strips each mounted on an inner face of said track wherever said track curves; and an actuator for each of said plurality of track-guided vehicles, said actuator able to decelerate said track-guided vehicle, said actuator triggered when any of the plurality of sensors mounted on the respective track-guided vehicle detect an identified reflection from another track-guided vehicle.

2. The system of claim 1 wherein said sensors are retroreflective sensors and said identifying reflective element is a corner cube reflecting element.

3. The system of claim 1 wherein said plurality of sensors include primary sensors and secondary sensors.

4. The system of claim 3 wherein said secondary sensors are selectively powered.

5. The system of claim 3 wherein said primary sensors include a left primary sensor and a right primary sensor.

6. The system of claim 4 wherein said primary sensors are disposed on the outer third of the vehicle and have a centerline at approximately the height of the strip of identifying reflective element.

7. The system of claim 6 wherein said plurality of sensors are focused at an inward angle.

8. The system of claim 6 wherein said plurality of sensors are disposed tilted upward at an angle.

9. The system of claim 8 wherein said angle is 15°.

10. The system of claim 1 wherein each sensor of the plurality of sensors includes an emitter and a receiver.

11. The system of claim 10 wherein the emitter is an LED.

12. The system of claim 1 wherein the plurality of sensors have a range of 70 inches.

13. The system of claim 1 wherein the strip of identifying reflective element substantially spans the back of said track-guided vehicle.

14. The system of claim 13 wherein the strip of identifying reflective element extends partially around the side of said track-guided vehicle.

15. The system of claim 1 wherein the plurality of highly reflective non-diffusing strips are disposed at a height substantially matching the height of the strip of identifying reflective element when the track-guided vehicle is disposed on the track.

16. A method for avoiding collisions of track-guided vehicles on a track, the method comprising:

placing a plurality of track-guided vehicles having a front and a back on the track;

affixing a plurality of sensors to the front of each of said plurality of track-guided vehicles, said plurality of sensors being placed and focused to illuminate a predetermined area in front of said track-guided vehicle;

mounting one of a plurality of strips of identifying reflective element to each of said plurality of track-guided vehicles; said strip being disposed at a predetermined height;

mounting a plurality of highly reflective non-diffusing strips on an inner face of said track wherever said track curves; and decelerating said track-guided vehicle through an actuator, when any of the plurality of selective sensors mounted on the track-guided vehicle detect an identified reflection from another track-guided vehicle.

17. The method of claim 16 wherein said sensors are retroreflective sensors and said identifying reflective element is a corner cube reflecting element.

18. The method of claim 16 wherein said plurality of sensors include primary sensors and secondary sensors.

19. The method of claim 18 wherein said secondary sensors are selectively powered.

20. The method of claim 18 wherein said primary sensors include a left primary sensor and a right primary sensor.

21. The method of claim 16 wherein said affixing step includes affixing said primary sensors on the outer third of the vehicle at a height approximately equal to the height of the strip of identifying reflective element.

22. The method of claim 16 wherein said plurality of sensors are focused at an inward angle.

23. The method of claim 16 wherein said plurality of sensors are disposed tilted upward at an angle.

24. The method of claim 16 wherein said angle is 15°.

25. The method of claim 16 wherein each sensor of the plurality of sensors includes an emitter and a receiver.

26. The method of claim 25 wherein the emitter is an LED.

27. The method of claim 16 wherein the plurality of sensors have a range of 70 inches.

28. The method of claim 16 wherein the strip of identifying reflective element substantially spans the back of said track-guided vehicle.

29. The method of claim 28 wherein the strip of identifying reflective element extends partially around the side of said track-guided vehicle.

30. The method of claim 16 wherein the plurality of highly reflective non-diffusing strips are disposed at a height substantially matching the height of the strip of identifying reflective element when the track-guided vehicle is disposed on the track.

* * * * *

UNITED STATES PATENT AND TRADEMARK OFFICE

CERTIFICATE OF CORRECTION

PATENT NO. : 6,290,188 B1
DATED : September 18, 2001
INVENTOR(S) : Michael R. Bassett It is certified that error appears in the above-identified patent and that said Letters Patent is hereby corrected as shown below:

Drawings,

Please replace Fig. 7 with new Fig. 7 as follows:

--

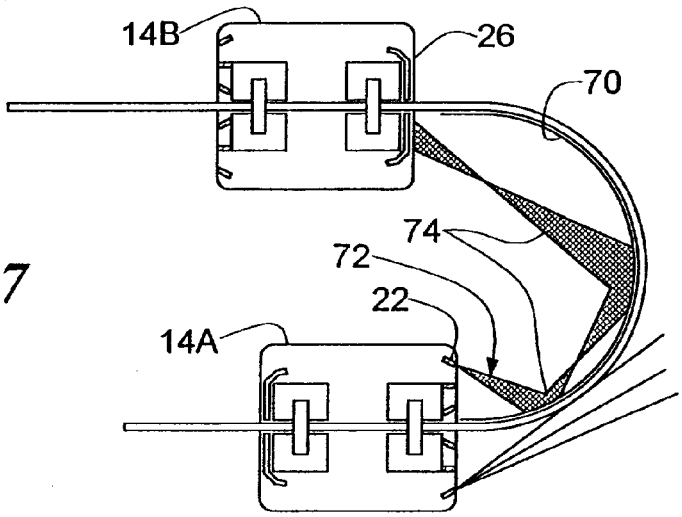

*FIG. 7*

--

UNITED STATES PATENT AND TRADEMARK OFFICE

CERTIFICATE OF CORRECTION

PATENT NO. : 6,290,188 B1
DATED : September 18, 2001
INVENTOR(S) : Michael R. Bassett It is certified that error appears in the above-identified patent and that said Letters Patent is hereby corrected as shown below:

Drawings,
Please replace Fig. 8 with new Fig. 8 as follows:

--

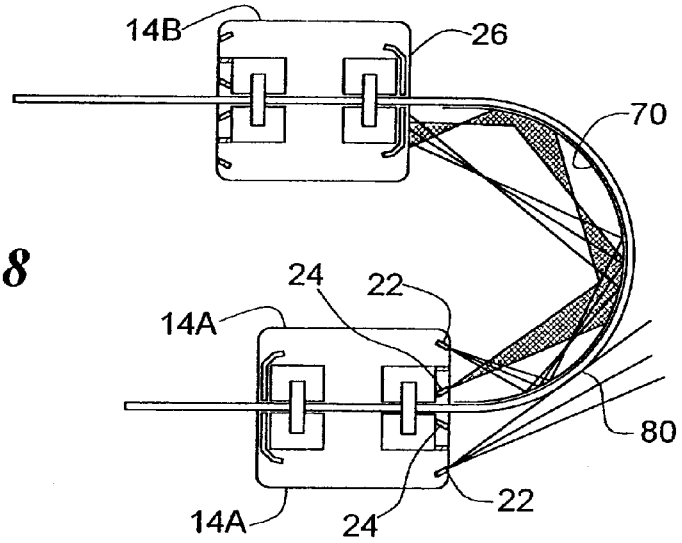

*FIG. 8*

--

UNITED STATES PATENT AND TRADEMARK OFFICE

CERTIFICATE OF CORRECTION

PATENT NO. : 6,290,188 B1
DATED : September 18, 2001
INVENTOR(S) : Michael R. Bassett It is certified that error appears in the above-identified patent and that said Letters Patent is hereby corrected as shown below:

Column 3,
Line 29, "singe" should read -- single --; and

Column 5,
Line 63, "vehicles;" should read -- vehicles, --.

Signed and Sealed this

Twenty-third Day of July, 2002

*Attest:*

*Attesting Officer*

JAMES E. ROGAN
*Director of the United States Patent and Trademark Office*